United States Patent [19]

Stanfield

[11] Patent Number: 4,969,560

[45] Date of Patent: Nov. 13, 1990

[54] PORTABLE DISH RACK

[76] Inventor: John Stanfield, 425 Riverhill Dr., Atlanta, Ga. 30328

[21] Appl. No.: 398,253

[22] Filed: Aug. 24, 1989

[51] Int. Cl.[5] ..... A47G 19/08

[52] U.S. Cl. ..... 211/41; 211/175; 211/181

[58] Field of Search ..... 211/41, 181, 175

[56] References Cited

U.S. PATENT DOCUMENTS

| | | | |
|---|---|---|---|
| 1,480,043 | 1/1924 | Blakeslee | 211/41 X |
| 1,595,421 | 8/1926 | Rose . | |
| 1,822,087 | 9/1931 | Feingold | 211/41 X |
| 2,338,290 | 1/1944 | McDonald | 211/41 |
| 3,303,934 | 2/1967 | Pressley | 211/41 |
| 3,442,395 | 5/1969 | Taylor | 211/41 |
| 4,515,104 | 5/1985 | Lee | 118/500 |
| 4,566,839 | 1/1986 | Butler | 211/41 X |

FOREIGN PATENT DOCUMENTS

| | | | |
|---|---|---|---|
| 174267 | 4/1922 | United Kingdom | 211/41 |
| 446,807 | 5/1936 | United Kingdom | 211/41 |

*Primary Examiner*—Blair M. Johnson
*Attorney, Agent, or Firm*—Kennedy & Kennedy

[57] ABSTRACT

A dish rack has a wire mesh frame that defines a space in which a set of dishes may be supported uprightly. A lower plate support having a series of notches is mounted to the frame. A pair of upper plate supports each having a series of notches are adjustably mounted to the frame above and to opposite sides of said lower plate support.

12 Claims, 3 Drawing Sheets

PORTABLE DISH RACK

TECHNICAL FIELD

This invention relates generally to dish racks, and particularly to dish racks for use in carrying and for supporting dishes in dishwashers.

BACKGROUND OF THE INVENTION

In the restaurant, tableware rental, and food catering industries large numbers of dishes must be racked, washed and stacked. The sheer volume of such activity demands that dish racks be designed for ease and speed of loading and unloading. At the same time, they must be constructed so that likelihood of breakage is minimized during loading, unloading and transport. Where the racks are incorporated into or used in dishwashers, they must also be designed so that water sprays may effectively clean the dishes and provide for good drainage.

An early dish rack specifically designed for use in a dishwasher is shown in Rose U.S. Pat. No. 1,595,421. The dish rack here has a frame that supports a set of mutually spaced, parallel rods between which dishes are placed uprightly. Handles are provided for use in placing the rack loaded with dishes into and out of a dish washing machine.

A more recent dish rack design is shown in Pressley U.S. Pat. No. 3,303,934. The dish rack here is permanently mounted in a dishwasher. It has several sawtooth shaped support rods, selected grouping of which are used to support different sized dishes. Depending on their size, dishes are supported on as few as two or as many as six rods.

Dish racks of the types just described, which are specifically designed for use in dishwashers, have had several pronounced deficiencies. Probably foremost amongst these has been their inability to hold different size dishes in a secure manner. For example, with the Rose type rack the support rods are simply placed apart a distance sufficient to accommodate a selected maximum sized dish in order that it may be used to hold that size dish and smaller dishes. This results in good support for the largest size dishes but only loose support for the smaller dishes. It also sacrifices economy of space for the smaller dishes. Racks of the Pressley type also have this type problem. Their design scheme is to provide a sufficiently large number of supports so that several combinations are available to hold dishes of various sizes in a reasonably secure and separated manner. Inherently such designs suffer from excess structure and problems typically associated with compromise designs. Being built-in rather than portable, these type of racks also require that dishes be removed and either reracked or restacked outside of the dish washer for storage or transportation.

Accordingly, it is seen that a need still remains for a portable dish rack for use in dishwashers that can effectively and securely hold dishes of various sizes with minimal risk of breakage, which are readily placeable and removable from dishwashers and which are of economical construction. It is to the provision of such that present invention is primarily directed.

SUMMARY OF THE INVENTION

In a preferred form of the invention, a portable dish rack suitable for use in dishwashers comprises a frame defining dishes receiving space to which a lower plate support is mounted. A pair of upper plate supports is adjustably mounted to the frame above and to opposite sides of the lower plate support. So constructed, plates of various sizes may be securely supported by the lower support and the pair of adjustable upper plate supports within the dishes' receiving space.

BRIEF DESCRIPTION OF THE DRAWING

FIGS. 6A–E are side elevational views of the bottom support bar of the dish rack of FIG. 1 sequentially showing individual plates being loaded into the rack while

DETAILED DESCRIPTION

Figure 1:
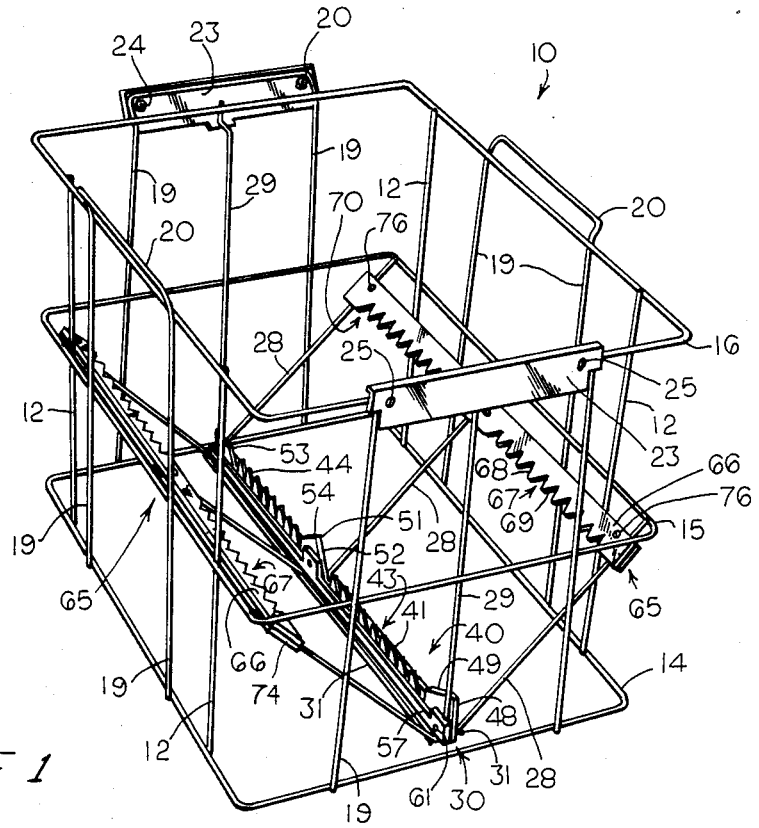
FIG. 1 is a perspective view of a dish rack embodying principles of the invention in a preferred form.
Figure 2:
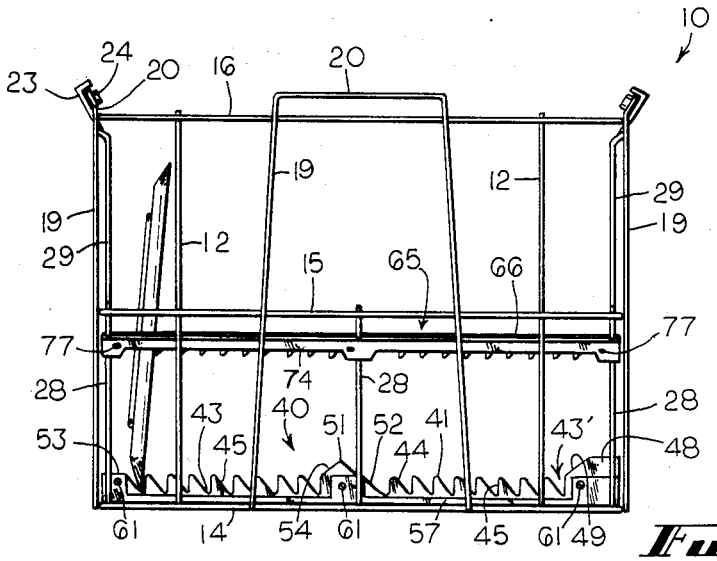
FIG. 2 is a side elevation view of the dish rack illustrated in FIG. 1 shown holding a plate.
Figure 3:
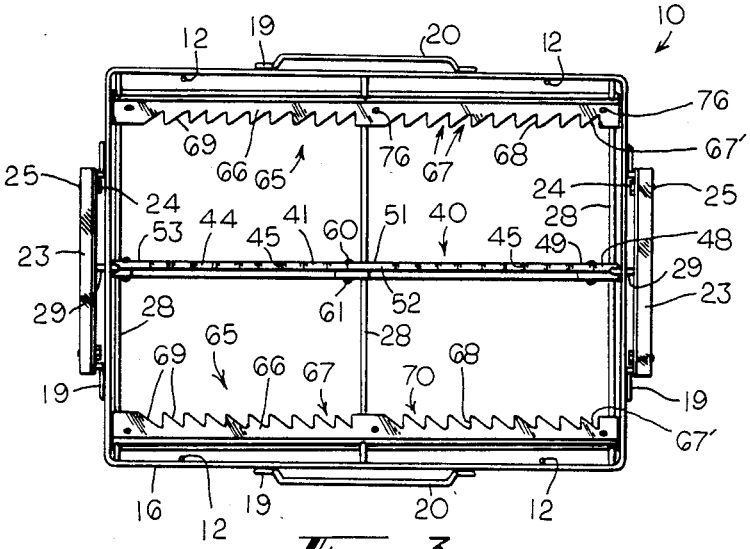
FIG. 3 is a top view of the dish rack shown in FIG. 1.
Figure 4:
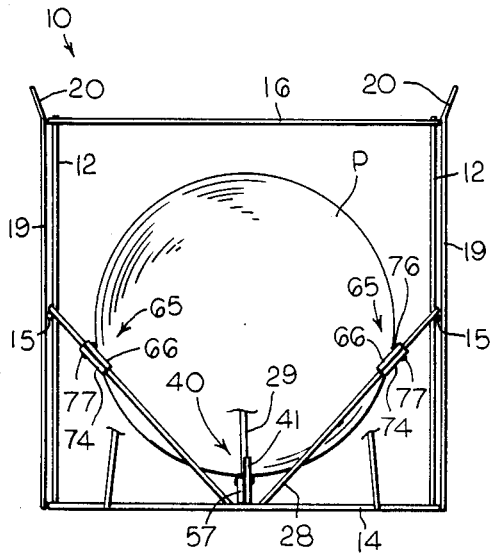
FIGS. 4 and 5 are front elevational views of the dish rack of FIG. 1 shown holding plates of different sizes and with some structural elements removed for clarity of illustration.
Figure 5:
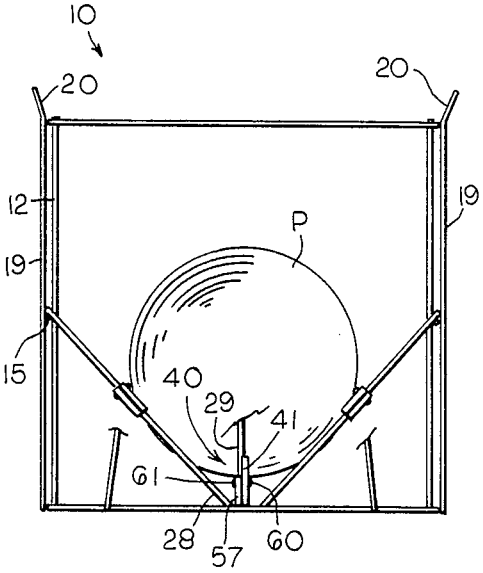

Referring now in more detail to the drawing, in which like numbers indicate like parts throughout the several views, FIGS. 1–5 show a dish rack 10 having a wire mesh frame that comprises three rectangular wire beam members, specifically a lower beam 14, a middle beam 15 and an upper beam 16 to which a set of wire side wall members 12 are bonded. Four inverted U-shaped wires 19 are affixed to the beams 14–16. Their upper portions or bights 20 are bent outwardly from the upper beam 16. Low heat transfer handles 23, preferably formed of plastic material, are fixedly mounted to upper portions 20 by nuts 24 and bolts 25.

Three V-shaped wire supports 28 are mounted at their upper ends to the middle beam 15 in longitudinally spaced relationship and with their bights 30 being substantially co-planar with the lower beam 14. The two legs of the support extend at right angles from each other from the bight. A wire hanger 29 mounted to the upper beam 16 supports the bights of two of the V-shaped end supports 28. Two brace wires 31 are affixed longitudinally to the bottom of the supports 28 so as to straddle their bights.

The dish rack 10 further has a lower plate support 40 which is rigidly mounted to the hangers 29. The lower plate support has a serrated member 41 and a support member 57 mounted flush together upon the bights 30 of the V-shaped supports 28. The serrated member 41 has a series of V-shaped notches, each of which has a plate support wall 45 and a bearing wall 44. The serrated member has an end section 48 formed with an inclined guide surface 49. It also has a middle section 51 with inclined guide surfaces 52 and 54, and another end section 53. The serrated member 41 and support member 57 are fixedly mounted to the hangers by nuts 60 and bolts 61.

A pair of upper plate supports 65 are adjustably mounted on the V-shaped supports 28. Each upper plate support has a serrated member 66 formed with a series of notches 67 and a support member 74 abutting the V-shaped supports 28. Each notch has a bearing wall 69 and a plate support wall 68. The serrated members 66 are mounted to support member 74 by bolts 76 and nuts 77.

In use, the upper plate supports 65 are slidably adjusted upon the V-shaped supports 28 so that the periphery of a plate P may be supported by the two upper plate supports 65 in addition to the lower support 40. The positions of the upper plate supports 65 are established by sliding them downwardly along the V-shaped supports 28 until they contact the periphery of a plate P that has been placed upon the lower plate support 40. The upper plate supports 65 are then fixed in place by tightening bolts 76 and nuts 77 which draw the serrated and support members tightly to the supports 28.

The rack may be loaded plate by plate. An initial plate $P_1$ is placed in the rack 10 by positioning it in the first notches 67' of the upper plate supports 65, and lowering the plate until it contacts the guide surface 49 of the lower plate support 40. As shown in FIGS. 6A–6E, the plate $P_1$ then slides down guide surface 49 onto the bearing surface 44 of the first notch 43' to become firmly seated against the plate support wall 45 of notch 43'.

Figure 6A:
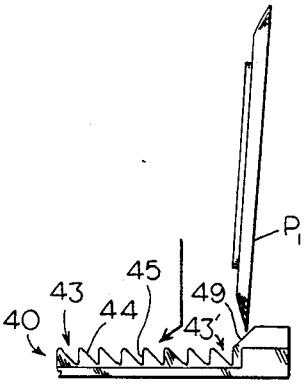
Figure 6B:
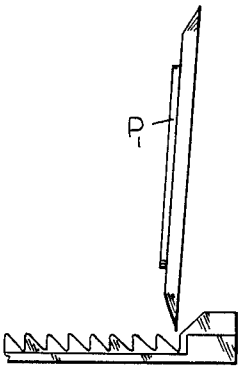
Figure 6C:
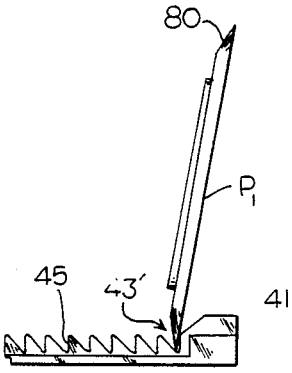
Figure 6D:
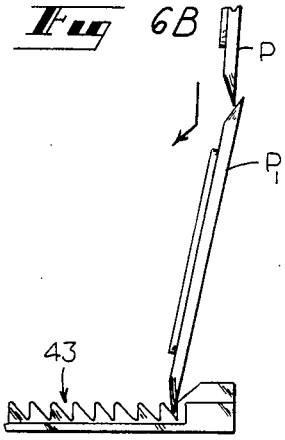
Figure 6E:
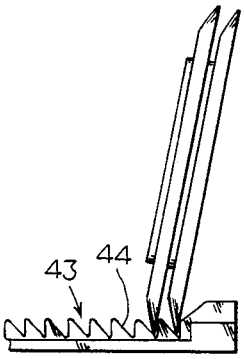
Figure 6F:
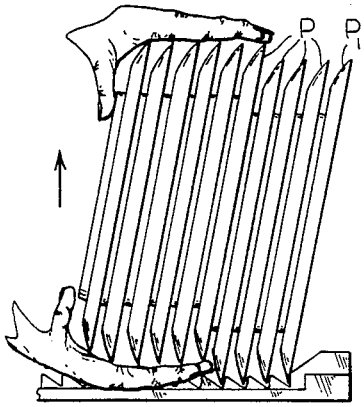
FIG. 6F shows a group of plates being loaded or unloaded as a set.

Additional plates are loaded by using the underside of a previously loaded plate as a guiding surface, as shown in FIGS. 6C and 6D. As the next plate P slides down surface 80 it is guided into the next notch 67 of upper plate supports 65. As it is lowered further it contacts the bearing wall 44 of lower plate support notch 43 and is seated in the bottom of that notch. Loading continues in this fashion until a plate is placed in the notch formed by bearing surface 52. The next plate racked rides down guide surface 54, of middle section 51, until it rides off the guide surface and settles in the notch 43 adjacent to guide surface 54. The remaining plates are positioned by using the plate adjacent to the next available notch, as explained before, until all notches are occupied or there are no plates remaining to be loaded. Alternatively, as shown in FIG. 6F, a person may grasp and load or unload several plates P at a time. This may be done with facility since the rack 10 does not employ wires between the upper portions of the plates. The loaded rack may then be placed in a dishwasher.

It should be noted that the lower plate support notches 43 are offset from the upper plate support notches 67. This is done so that seated plates are angled downwardly toward the end section 48, as shown best in FIGS. 6C and 6D. With the plates at such an angle, their faces are exposed to water jets that dishwashers usually have directed upwardly.

Racks of the type just described may also be stacked one upon another to facilitate storage and economy of space in transporting sets of dishes. In this regard the bent upper portions 20 of the U-shaped wires 19 are used as guides when stacking racks.

From the foregoing, it can be seen that dish rack is now provided which overcomes problems long associated with those of the prior art. It should, however, be understood that the just described embodiment merely illustrates principles of the invention in a preferred form. Many modifications, additions and deletions may, of course, be made thereto without departure from the spirit and scope of the invention as set forth in the following claims.

I claim:

1. A portable dish rack comprising a frame defining a space in which a set of dishes may be supported uprightly, a lower plate support mounted to said frame, at least two generally parallel V-shaped supports defined by portions extending divergently upwardly from said lower plate support, a pair of upper plate supports, and means for adjustably mounting said upper plate supports at a plurality of elevations along adjacent said portions said V-shaped supports above and to opposite sides of said lower plate support, whereby the peripheries of dishes of different sizes may be supported upon both the lower and upper plate supports by adjustment of the upper plate supports within the frame defining space.

2. A dish rack as claimed in claim 1 wherein said lower plate support has a series of notches.

3. A dish rack as claimed in claim 2 wherein each of said upper plate supports has a series of notches.

4. A dish rack as claimed in claim 3 wherein said upper plate support notches have substantially coplanar notch surface, and wherein said lower plate support notches have planar surfaces oriented parallel to said upper plate notch surfaces.

5. A dish rack as claimed in claim 2 wherein said lower plate support has a guide surface adjacent to an end notch in said series of notches for use in guiding the periphery of a dish into said end notch.

6. A dish rack as claimed in claim 1 wherein said generally V-shaped supports are rigidly mounted to said frame.

7. A dish rack as claimed in claim 1 wherein said V-shaped supports are formed of wires.

8. A dish rack as claimed in claim 1 further comprising a pair of handles mounted to and extending outwardly from said frame for hand carrying and for stacking a set of said dish racks.

9. A dish rack comprising a generally rectangular, open top wire mesh frame, a lower plate support mounted centrally to said frame and having a series of notches that open upwardly, a pair of substantially parallel wire supports mounted to said frame that comprise portions which extend divergently upward from adjacent said lower plate support, a pair of upper dish supports adjustably mounted to adjacent said portions of said pair of wire supports with each upper dish support having a series of notches, and means for mounting said upper dish supports at selected positions along adjacent said portions of said pair of wire supports.

10. A dish rack as claimed in claim 9 wherein said upper plate support notches are longitudinally offset and parallel to said lower plate support notches, whereby a plate supported by said supports may be downwardly tilted.

11. A dish rack as claimed in claim 9 wherein said upper dish support notches open inwardly and downwardly.

12. A dish rack as claimed in claim 9 wherein said wire supports are rigidly mounted to said frame.

* * * * *